US007558493B2

(12) United States Patent
Kwon

(10) Patent No.: US 7,558,493 B2
(45) Date of Patent: Jul. 7, 2009

(54) FULL-LOADING SENSING DEVICE FOR AN IMAGE FORMING APPARATUS

(75) Inventor: Jae-min Kwon, Anyang-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 350 days.

(21) Appl. No.: 11/509,593

(22) Filed: Aug. 25, 2006

(65) Prior Publication Data

US 2007/0104497 A1 May 10, 2007

(30) Foreign Application Priority Data

Nov. 7, 2005 (JP) ..... 10-2005-0105952

(51) Int. Cl.
*G03G 15/00* (2006.01)

(52) U.S. Cl. ..... 399/16; 399/405; 400/703

(58) Field of Classification Search ..... 399/16, 399/35

See application file for complete search history.

(56) References Cited

U.S. PATENT DOCUMENTS 5,963,754 A * 10/1999 Itoh et al. ..... 399/21

FOREIGN PATENT DOCUMENTS

| | | | |
|---|---|---|---|
| JP | 09-020036 | | 1/1997 |
| JP | 09249334 | A * | 9/1997 |
| JP | 1998-059230 | | 10/1998 |
| JP | 2000-177911 | | 6/2000 |
| JP | 2002-167119 | | 6/2002 |
| JP | 20020167119 | A * | 6/2002 |
| JP | 2003302797 | A * | 10/2003 |
| JP | 10-2004-0021159 | A | 3/2004 |
| JP | 2005004122 | A * | 1/2005 |
| JP | 2005-035064 | | 2/2005 |

* cited by examiner

*Primary Examiner*—Daniel J Colilla
*Assistant Examiner*—Allister Primo
(74) *Attorney, Agent, or Firm*—Roylance, Abrams, Berdo and Goodman, LLP

(57) ABSTRACT

A full-loading sensing device and method thereof is provided for an image forming apparatus. The full-loading sensing device includes at least one lever rotated in different directions from reference locations by loading of a discharged paper and opening of a jam removal cover, respectively, and an optical sensor for sensing different rates of change in an amount of light corresponding to respective rotational directions of the lever. It is thereby possible to provide a single sensing mechanism that is capable of sensing and distinguishing both a full-loading state and a jam removal cover-open state.

28 Claims, 5 Drawing Sheets

FULL-LOADING SENSING DEVICE FOR AN IMAGE FORMING APPARATUS

CROSS-REFERENCE TO RELATED APPLICATIONS

This application claims the benefit under 35 U.S.C. §119 (a) of Korean Patent Application No. 10-2005-0105952, filed in the Korean Intellectual Property Office on Nov. 7, 2005, the entire disclosure of which is incorporated herein by reference.

BACKGROUND OF THE INVENTION

1. Field of the Invention

The present invention relates to an image forming apparatus. More particularly, the present invention relates to a full-loading sensing device for sensing loading states of discharged papers.

2. Description of the Related Art

Image forming apparatuses such as facsimiles, laser beam printers, ink-jet printers and copiers function to form an image on a recording medium like a printing paper and output the image-formed recording medium. According to image forming methods, image forming apparatuses may be classified as an indirect type utilizing an indirect medium like a photosensitive body to form an image, and a direct type directly jetting or transferring ink to a recording medium to form an image.

Such an image forming apparatus includes an image forming unit for forming an image on a recording medium supplied from a paper feeding cassette, and an output bin section on which the recording medium having the image formed by the image forming unit is discharged and loaded.

The output bin section is a loading plate having a constant height. Plural sheets of discharged papers are piled up to a predetermined height on the output bin section. The output bin section usually has a loading capacity of 50 to 100 sheets of discharged papers. If the number of discharged papers piled on the output bin section exceeds this loading capacity, newly discharged papers can be interrupted by the discharged papers already piled, thereby causing various printing-related errors. Thus, a full-loading sensing device is demanded, which is capable of determining if the number of discharged papers piled on the output bin section exceeds a predetermined limit (hereinafter referred to as full-loading state), and stopping the image forming apparatus or informing the user of the full-loading state with visual or audible means when the full-loading state is detected.

A conventional full-loading sensing device of the image forming apparatus includes a lever for contacting the discharged papers piled on the output bin section, and a sensor for detecting a full-loading state.

Another feature of such devices, is an openable/closable jam removal cover that is provided near the full-loading sensing device to permit removal of a recording media causing a jam in an arrangement unit or paper discharge unit of the image forming apparatus. A separate jam removal cover sensor is connected to the jam removal cover to sense an open or closed state thereof. If this jam removal cover sensor detects an open state of the jam removal cover, internal power is turned off to stop the operation of the image forming apparatus.

As described above, in the conventional image forming apparatus, the full-loading sensing device and jam removal cover-open sensing device are provided separately, thereby increasing the number of components to be assembled including sensors and sensor brackets, and thereby raising assembly costs.

In addition, in the case where the full-loading sensing device and jam removal cover-open sensing device are used together to form an integrated sensing mechanism, measurement signals produced from these two sensing devices may overlap each other to thereby complicate interpretation of the signals, leading to various operational errors which can cause accidents and lower product reliability.

Accordingly, a need exists for a simpler and effective system and method for sensing and distinguishing both a full-loading state and a jam removal cover-open state of an image forming apparatus.

SUMMARY OF THE INVENTION

An aspect of embodiments of the present invention is to substantially solve at least the above problems and/or disadvantages, and to provide at least the advantages described below. Accordingly, an aspect of embodiments of the present invention is to provide a full-loading sensing device for an image forming apparatus, which is capable of detecting and distinguishing both a full-loading state and a jam removal cover-open state by combining a conventional jam removal cover-open sensing device and a full-loading sensing device into a new integrated mechanism.

Another aspect of embodiments of the present invention is to provide a full-loading sensing device wherein a simplified sensing mechanism is provided near an output bin section of an image forming apparatus to thereby minimize operational errors and increase product reliability.

In accordance with an exemplary embodiment of the present invention, the full-loading sensing device comprises at least one lever rotated in different directions from reference locations by loading of a discharged paper and opening of a jam removal cover, respectively, and an optical sensor for sensing different rates of change in an amount of light corresponding to respective rotational directions of the lever.

The lever preferably comprises a light transmitting portion provided closely to the optical sensor.

It is preferable that the light transmitting portion comprises a translucent material.

In addition, the lever comprises a first lever whose one end is contactable with the discharged paper loaded on an output bin section, and a second lever connected in an interlocked manner with the first lever, wherein the first lever and second lever are rotatable in an interlocked manner, and the second lever comprises a light transmitting portion having a light transmittance differing from that of the second lever at a site near the optical sensor.

The other end of the first lever is preferably adapted to contact a lower part of the jam removal cover.

Alternatively, a pressurizing member can be elastically disposed under the jam removal cover and a pressure rib can be adapted to project from a side of the pressurizing member.

In accordance with another exemplary embodiment of the present invention, the full-loading sensing device comprises a first lever that is rotated in one direction by loading of a discharged paper and rotated in the other direction by opening of a jam removal cover, a second lever rotatable in both directions reversely corresponding to rotational directions of the first lever, an optical sensor for sensing different rates of change in an amount of light corresponding to respective rotational directions of the second lever, and a light transmitting portion provided at a part of the second lever near the optical sensor, the light transmitting portion having a light transmittance differing from that of the second lever.

The light transmitting portion preferably comprises a translucent material.

It is preferable that the first lever comprises one end that is contactable with the discharged paper loaded on an output bin section and the other end that is contactable with the jam removal cover mounted in an openable/closable manner to a main body, and is adapted to rotate in directions opposite to each other in response to the loading of the discharged paper and the opening of the jam removal cover, respectively.

The optical sensor can convert the sensed different rates of change in the amount of light into respectively corresponding voltage signals.

In accordance with yet another exemplary embodiment of the present invention, the full-loading sensing device comprises a first lever rotated by loading of a discharged paper, a second lever rotated in one direction by the rotation of the first lever and in the other direction by opening of a jam removal cover, an optical sensor for sensing rates of change in an amount of light according to two directional rotation of the second lever, and a light transmitting portion provided at an end of the second lever near the optical sensor, the light transmitting portion comprising a light transmittance differing from that of the second lever.

The light transmitting portion preferably comprises a translucent material.

It is preferable that a pressurizing member is disposed in an elastically supported manner under the jam removal cover, and a pressure rib is adapted to project from a side of the pressurizing member, the pressure rib rotating the second lever in the other direction.

It is preferable that the optical sensor converts the sensed different rates of change in the amount of light into respectively corresponding voltage signals.

BRIEF DESCRIPTION OF THE DRAWING FIGURES

The above aspects and other features of embodiments of the present invention will become more apparent by describing in detail exemplary embodiments thereof with reference to the attached drawing figures, wherein.

Throughout the drawings, like reference numerals will be understood to refer to like parts, components and structures.

DETAILED DESCRIPTION OF THE EXEMPLARY EMBODIMENTS

Figure 1A:
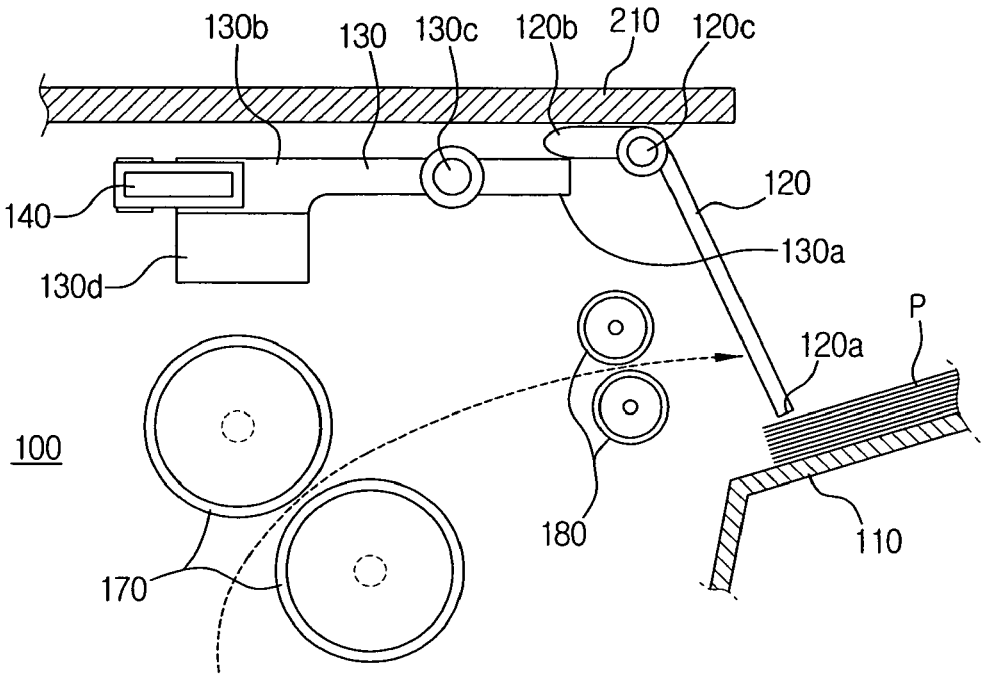
FIG. 1A is a schematic view of a full-loading sensing device according to a first embodiment of the present invention.

Hereinafter, exemplary embodiments of the present invention will be described in detail with reference to the accompanying drawing figures.

In the following description, same drawing reference numerals are used for the same elements even in different drawings. The matters defined in the description, such as a detailed construction and elements are provided to assist in a comprehensive understanding of the invention. Also, well-known functions or constructions are not described in detail since they would obscure the invention in unnecessary detail.

FIGS. 1A to 3 show a full-loading sensing device according to a first embodiment of the present invention.

As shown in FIGS. 1A to 3, the full-loading sensing device according to embodiments of the present embodiment comprises a first lever 120 for contacting discharged papers P piled on an output bin section 110, a second lever 130 for contacting the first lever 120, and an optical sensor 140 disposed closely to the second lever 130.

In a main body 100 of an image forming apparatus, an image forming unit (not shown) forms an image on a recording medium like a printing paper, and a fixing unit 170 fixes the formed image on the recording medium. The image-fixed recording medium (hereinafter, referred to as a 'discharged paper') is discharged through a paper discharge unit 180 and loaded on the output bin section 110 arranged at an outer side of the main body 100.

The first lever 120 is provided near the paper discharge unit 180 in the main body 100 so as to be rotatable around a shaft 120*c*, and one end 120*a* thereof may or may not contact the topmost one of discharged papers P piled on the output bin section 110. That is, the one end 120*a* of the first lever 120 may be designed to contact continuously a discharged paper P on the output bin section 110 as shown in FIG. 1A, or contact only in a full-loading state.

The other end 120*b* of the first lever 120 is interlockingly and/or frictionally connected with one end 130*a* of the second lever 130. The upper surface of the other end 120*b* is adapted to contact the lower part of a jam removal cover 210 in a closed state. The jam removal cover 210 is mounted in an openable/closable manner to the main body 100.

In the first lever 120, the one end 120*a* is configured to be heavier than the other end 120*b* so that when the jam removal cover 210 is open and thereby removes a pressing force applied to the other end 120*b*, the first lever 120 rotates downward (clockwise around 120*c*) owing to the weight of the one end 120*a*.

The second lever 130 is provided in the main body 100 so as to be rotatable around a shaft 130*c*. The one end 130*a* of the second lever 130 is interlockingly and/or frictionally connected with the other end 120*b* of the first lever 120. The optical sensor 140 is disposed adjacently to the other end 130*b* of the second lever 130.

In the second lever 130, similarly to the case of the first lever 120, the weight of the other end 130*b* is configured to be heavier than that of the one end 130*a*. Thus, when the jam removal cover 210 is open and the first lever 120 rotates downward owing to the weight of the one end 120*a* thereof, the second lever 130 also rotates downward (counter-clockwise around 130*c*) in response to the weight of the one end 130*a* and/or the downward rotation of the first lever 120.

In the interlocking and/or frictional structure between the first lever 120 and second lever 130 illustrated in FIGS. 1A to 3, the other end 120*b* of the first lever 120 is designed to contact the one end 130*a* of the second lever 130. However, embodiments of the present invention are not limited thereto. That is, any desired interlocking structure between the first lever 120 and second lever 130 can be utilized. For example, in another embodiment of the present invention the other end 120*b* of the first lever 120 may be link-coupled with the one end 130*a* of the second lever 130.

A light transmitting portion 130*d* is provided at the other end 130*b* of the second lever 130. The light transmitting portion 130*d* preferably comprises a material having a light transmittance differing from that of the second lever 130. The light transmitting portion material further has a light transmittance differing from that of unobstructed or empty space. Thus, there are detectable rates of change in the amount of light when the second lever 130 rotates across the light path of the optical sensor 140.

For easy detection of the rates of change in the amount of light through the optical sensor 140, it is preferable that the light transmitting portion 130*d* comprises a translucent material.

Figure 1B:
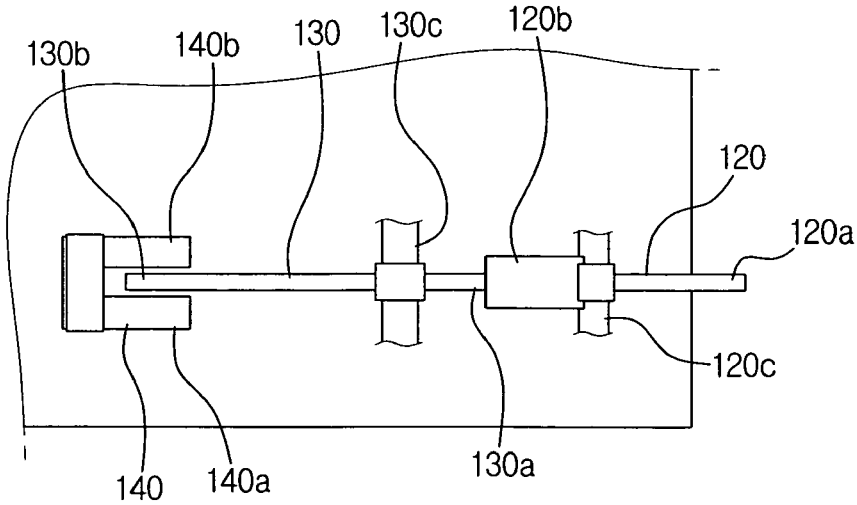
FIG. 1B is a plan view of the full-loading sensing device of FIG. 1A excluding a jam removal cover.

As illustrated in FIG. 1B, the optical sensor 140 comprises a light emitting portion 140*a* and a light receiving portion 140*b*, and can detect both the full-loading state of the output bin section 110 and an open state of the jam removal cover 210 by sensing the rates of change in the amount of light corresponding to the rotation of the other end 130*b* of the second lever 130 across the light path between the light emitting portion 140*a* and light receiving portion 140*b*.

In the exemplary embodiment of the present embodiment shown, the optical sensor 140 is a light emitting photo-sensor in which a light emitting portion 140*a* and light receiving portion 140*b* are disposed on the same optical axis so as to face each other. However, the optical sensor 140 of embodiments of the present invention is not limited to the light emitting photo-sensor, and can comprise any one of various types of optical sensors such as mirror-reflection photo-sensors and direct-reflection photo-sensors.

Hereinafter, a detailed description will be made of an exemplary operation of the full-loading sensing device having the above-described configuration according to the first embodiment of the present invention.

Figure 2:
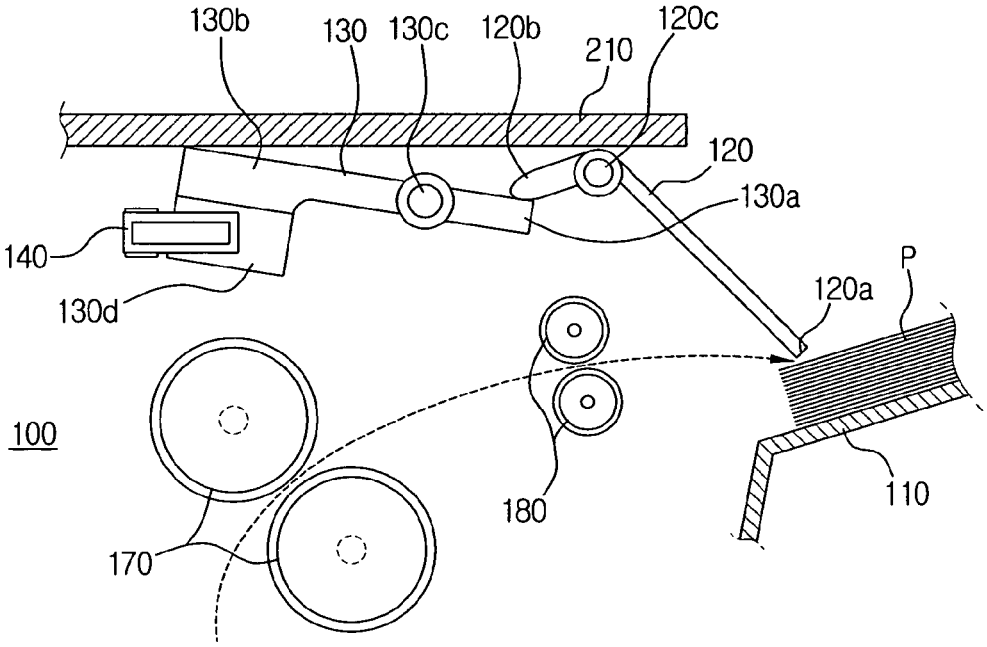
FIG. 2 is a view of the full-loading sensing device of FIG. 1A in a full-loading state.

In a closed state of the jam removal cover 210 at the main body 100 as shown in FIG. 1A, a discharged paper P passing through the fixing unit 170 and paper discharge unit 180 is discharged and loaded on the output bin section 110. The discharged paper P loaded on the output bin section 110 may or may not contact the one end 120*a* of the first lever 120. When it is not yet the full-loading state and the jam removal cover 210 is in a closed state, the first lever 120 and second lever 130 maintain respective reference locations as set in advance. When the number of discharged papers P piled on the output bin section 110 increases to reach the full-loading state as shown in FIG. 2, the one end 120*a* of the first lever 120 moves upward owing to the loading of discharged papers P, and the first lever 120 rotates counter-clockwise around the shaft 120*c* and the other end 120*b* of the first lever 120 is adapted to downwardly press the one end 130*a* of the second lever 130. As a result, the one end 130*a* of the second lever 130 moves downward, the second lever 130 rotates clockwise around the shaft 130*c*, and the other end 130*b* of the second lever 130 moves upward from the light path between the light emitting and receiving portions 140*a* and 140*b* of the optical sensor 140. At this time, the optical sensor 140 senses rates of change in the amount of light penetrating the light transmitting portion 130*d* near the other end 130*b* of the second lever 130. The sensed rates of change in the amount of light are converted into a pulse-shaped voltage signal as shown in FIG. 7.

Figure 7:
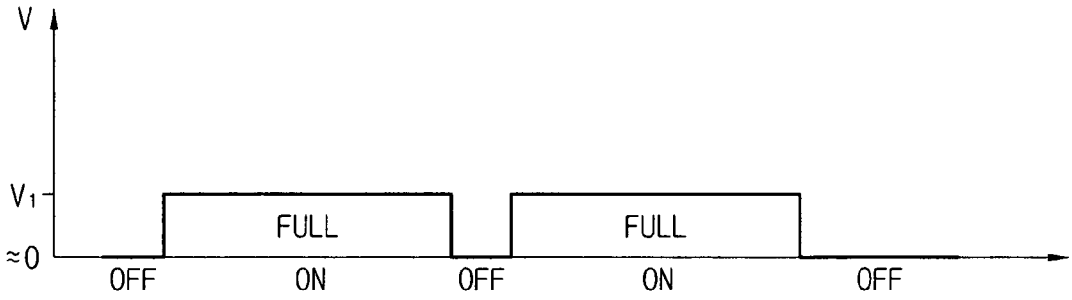
FIG. 7 is a graph of a voltage signal in the full-loading state according to an embodiment of the present invention.

FIG. 7 is a graph of the voltage signal when the output bin section 110 is completely filled with discharged papers P. In FIG. 7, the voltage signal is 'ON' in the full-loading state, and 'OFF' when not in the full-loading state.

If a discharged paper P being discharged through the fixing unit 170 and paper discharge unit 180 causes a paper jam, the user opens the jam removal cover 210 and removes the jammed discharged paper P.

Figure 3:
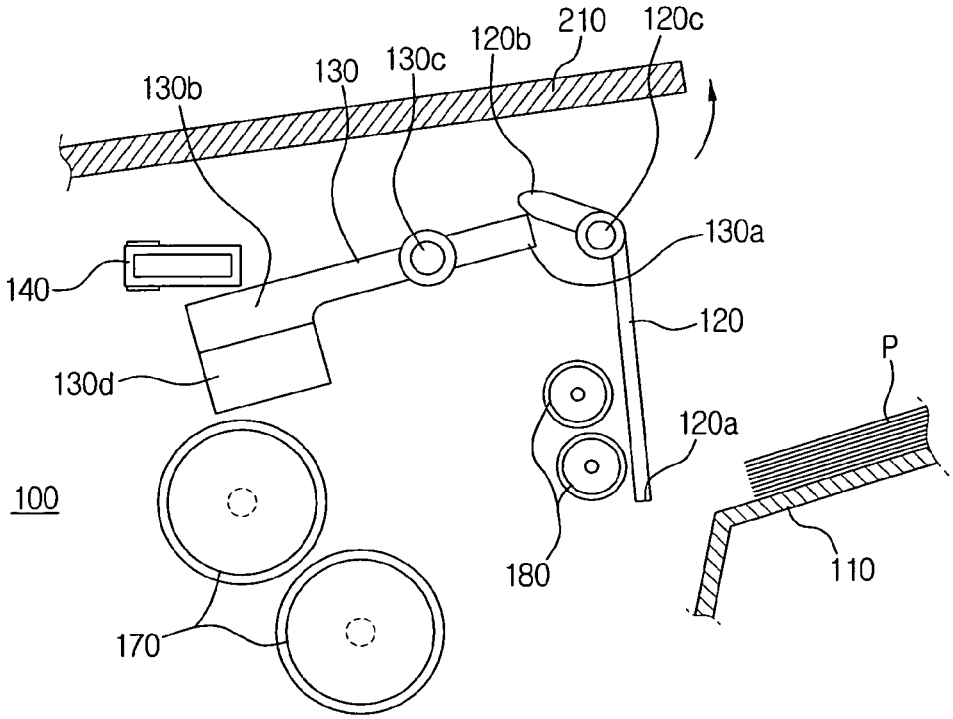
FIG. 3 is a view of the full-loading sensing device of FIG. 1A in a jam removal cover-open state.

When the jam removal cover 210 is opened as shown in FIG. 3, the other end 120*b* of the first lever 120 is no longer pressed by the jam removal cover 210 and moves upward, and the first lever 120 rotates clockwise around the shaft 120*c* and the one end 120*a* of the first lever 120 moves downward. As a result, the one end 130*a* of the second lever 130 is no longer pressed by the other end 120*b* of the first lever 120 and moves upward, the second lever 130 rotates counter-clockwise around the shaft 130*c*, and the other end 130*b* of the second lever 130 moves downward.

Figure 8:
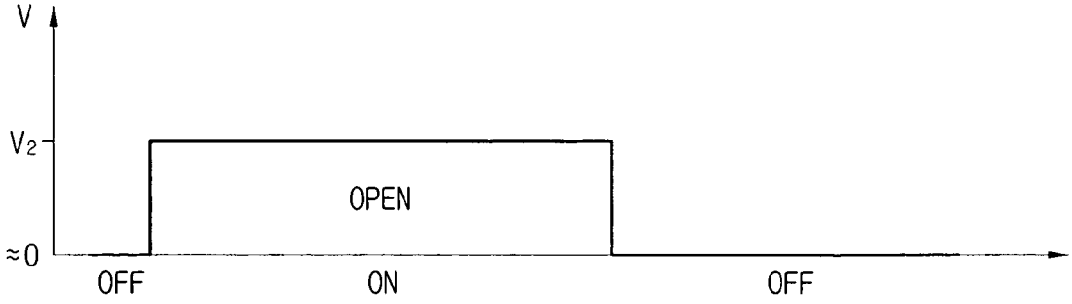
FIG. 8 is a graph of a voltage signal in the jam removal cover-open state according to an embodiment of the present invention.

If the other end 130*b* of the second lever 130 moves downward and escapes from the light path between the light emitting and receiving portions 140*a* and 140*b* of the optical sensor 140, the optical sensor 140 emits light to an empty space and senses rates of change in the amount of light. The sensed rates of change in the amount of light are converted into a pulse-shaped voltage signal as shown in FIG. 8. FIG. 8 is a graph of the voltage signal when the jam removal cover 210 is open. In FIG. 8, the voltage signal is 'ON' in an open state of the jam removal cover 210, and 'OFF' in a closed state of the jam removal cover 210.

In embodiments of the present invention, the sensed rate of change in the amount of light in the full-loading state ($V_1$ of FIG. 7) is less than that in the case of the jam removal cover-open state ($V_2$ of FIG. 8), but is greater than zero. That is, the signal values $0<V_1<V_2$, can then be used to selectively distinguish between at least one of a normal condition, a full-loading condition, and a jam removal cover-open condition, respectively.

In embodiments of the present embodiment, because the rates of change in the amount of light in the full-loading state and jam removal cover-open state are sensed differently from each other through the optical sensor 140 unlike conventional full-loading sensing devices, corresponding signals do not overlap each other, leading to easy interpretation of the signals. Accordingly, sensing of the full-loading state of the output bin section and sensing of opened jam removal cover can be performed in a separate or integrated mode.

FIGS. 4A to 6 show a full-loading sensing device according to the second embodiment of the present invention.

As shown in FIGS. 4A to 6, the full-loading sensing device according to embodiments of the present embodiment comprises a first lever 520 for contacting discharged papers P piled on an output bin section 510, a second lever 530 for contacting the first lever 520, and an optical sensor 540 disposed closely to the second lever 530.

Figure 4A:
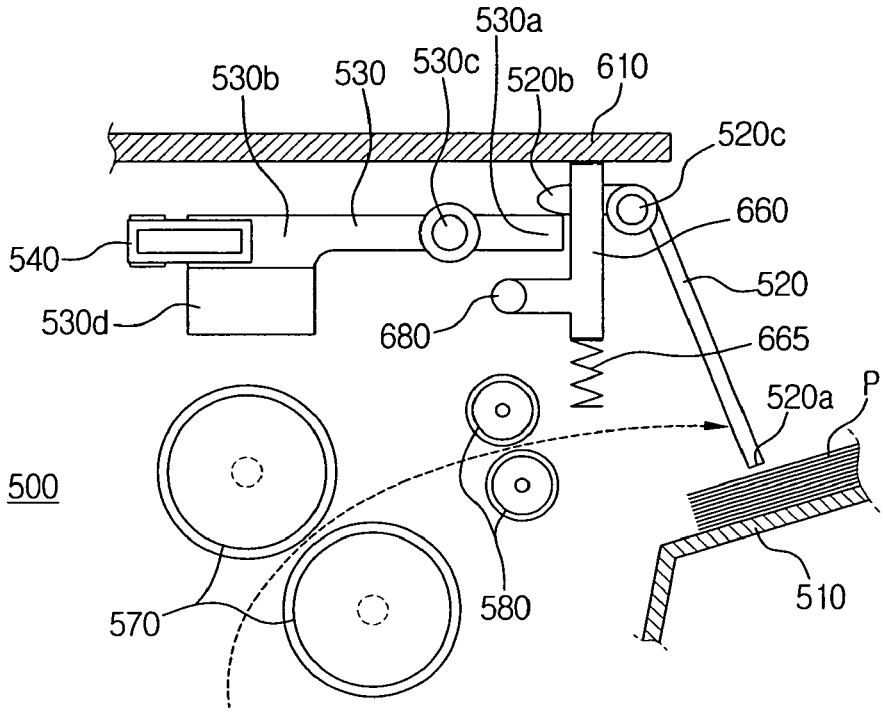
FIG. 4A is a schematic view of a full-loading sensing device according to a second embodiment of the present invention.

The first lever 520 is provided near a paper discharge unit 580 in a main body 500 so as to be rotatable around a shaft 520*c*, and one end 520*a* thereof may or may not contact the topmost one of discharged papers P piled on the output bin section 510. That is, the one end 520*a* of the first lever 520 may be designed to continuously contact a discharged paper P on the output bin section 510 as shown in FIG. 4A, or contact only in the full-loading state.

The other end 520*b* of the first lever 520 is preferably interlockingly and/or frictionally connected with one end 530*a* of the second lever 530.

A pressurizing member 660 is supported elastically by an elastic member 665 at a site where the first lever 520 and second lever 530 are interconnected. The upper surface of the pressurizing member 660 is adapted to contact a jam removal cover 610 in a closed state. The jam removal cover 610 is provided in an openable/closable manner at the main body 500.

A bent pressure rib 680 is formed at a side of the pressurizing member 660, and is disposed under the one end 530*a* of the second lever 530.

The pressurizing member 660 and pressure rib 680 rotate the first lever 520 and second lever 530 downward when the jam removal cover 610 is opened.

The second lever 530 is provided in the main body 500 so as to be rotatable around a shaft 530*c*. The one end 530*a* of the second lever 530 is preferably interlockingly and/or frictionally connected with the other end 520*b* of the first lever 520. The optical sensor 540 is disposed adjacently to the other end 530*b* of the second lever 530.

In the interlocking and/or frictional structure between the first lever 520 and second lever 530 illustrated in FIGS. 4A to 6, the other end 520*b* of the first lever 520 is designed to contact the one end 530*a* of the second lever 530. However, embodiments of the present invention are not limited thereto. That is, any desired interlocking structure between the first lever 520 and second lever 530 can be utilized. For example, in another embodiment of the present invention the other end 520*b* of the first lever 520 may be link-coupled with the one end 530*a* of the second lever 530.

A light transmitting portion 530*d* is provided at the other end 530*b* of the second lever 530. The light transmitting portion 530*d* preferably comprises a material having a light transmittance differing from that of the second lever 530. The light transmitting portion material further has a light transmittance differing from that of unobstructed or empty space. Thus, there are detectable rates of change in the amount of light when the second lever 530 rotates across the light path of the optical sensor 540.

For easy detection of the rates of change in the amount of light through the optical sensor 540, it is preferable that the light transmitting portion 530*d* comprises a translucent material.

Figure 4B:
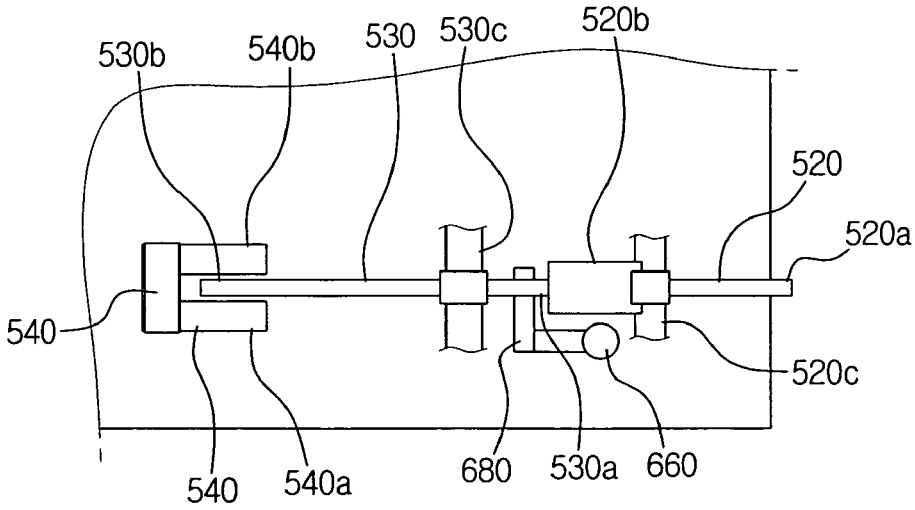
FIG. 4B is a plan view of the full-loading sensing device of FIG. 4A excluding a jam removal cover.

As illustrated in FIG. 4B, the optical sensor 540 comprises a light emitting portion 540*a* and a light receiving portion 540*b*, and detects both a full state of the output bin section 510 and an open state of the jam removal cover 610 by sensing the rates of change in the amount of light corresponding to the rotation of the other end 530*b* of the second lever 530 across the light path between the light emitting portion 540*a* and light receiving portion 540*b*.

In the exemplary embodiment of the present invention shown, the optical sensor 540 comprises a light emitting photo-sensor in which a light emitting portion 540*a* and light receiving portion 540*b* are provided on the same optical axis so as to face each other. However, the optical sensor 540 of embodiments of the present invention is not limited to the light emitting photo-sensor, and can comprise any one of various types of optical sensors such as mirror-reflection photo-sensors and direct-reflection photo-sensors.

Hereinafter, a detailed description will be made of an exemplary operation of the full-loading sensing device having the above-described configuration according to the second embodiment.

In a closed state of the jam removal cover 610 at the main body 500 as shown in FIG. 4A, a discharged paper P passing through the fixing unit 570 and paper discharge unit 580 is discharged and loaded on the output bin section 510. The discharged paper P loaded on the output bin section 510 may or may not contact the one end 520*a* of the first lever 520. When it is not yet the full-loading state and the jam removal cover 610 is in a closed state, the first lever 520 and second lever 530 maintain respective reference locations as set in advance.

Figure 5:
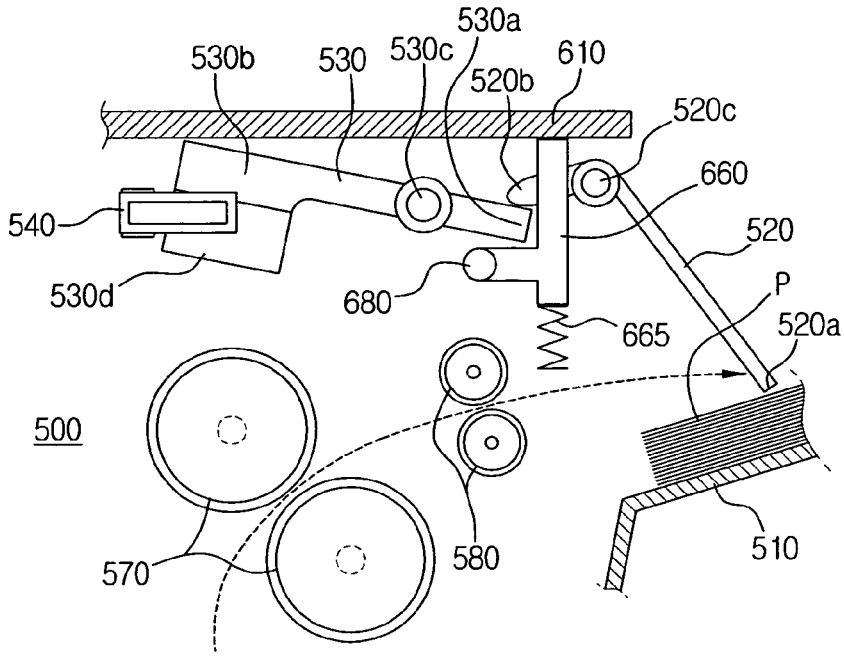
FIG. 5 is a view of the full-loading sensing device of FIG. 4A in a full-loading state.

When the number of discharged papers P piled on the output bin section 510 increases to reach the full-loading state as shown in FIG. 5, the one end 520*a* of the first lever 520 moves upward owing to the loading of discharged papers P, and the first lever 520 rotates counter-clockwise around the shaft 520*c* and the other end 520*b* of the first lever 520 downwardly presses the one end 530*a* of the second lever 530. As a result, the one end 530*a* of the second lever 530 moves downward, the second lever 530 rotates clockwise around the shaft 530*c*, and the other end 530*b* of the second lever 530 moves upward from the light path between the light emitting and receiving portions 540*a* and 540*b* of the optical sensor 540, placing the light transmitting portion 530*d* in the light path. At this time, the optical sensor 540 senses rates of change in the amount of light penetrating the light transmitting portion 530*d*. The sensed rates of change in the amount of light are converted into a pulse-shaped voltage signal as shown in FIG. 7. FIG. 7 is a graph of the voltage signal when the output bin section 510 is completely filled with discharged papers P. In FIG. 7, the voltage signal is 'ON' in the full-loading state, and 'OFF' when not in the full-loading state.

If a discharged paper P being discharged through the fixing unit 570 and paper discharge unit 580 causes a jam, the user opens the jam removal cover 610 and removes the jammed discharged paper P.

Figure 6:
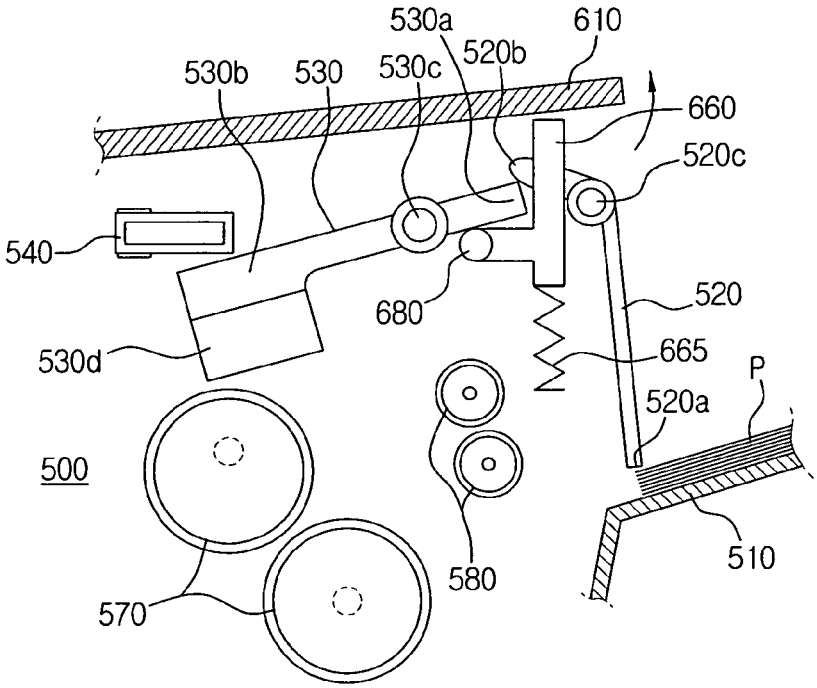
FIG. 6 is a view of the full-loading sensing device of FIG. 4A in a jam removal cover-open state.

When the jam removal cover 610 is opened as shown in FIG. 6, the pressurizing member 660 is no longer pressed by the jam removal cover 610 and moves upward owing to the elastic force of the elastic member 665 and the pressure rib 680 applies upward pressure to the one end 530*a* of the second lever 530.

As a result, the second lever 530 rotates counter-clockwise around the shaft 530*c*, and the other end 530*b* of the second lever 530 moves downward.

If the other end 530*b* of the second lever 530 moves downward and escapes from the light path between the light emitting and receiving portions 540*a* and 540*b* of the optical sensor 540, the optical sensor 540 emits light to an empty space and senses rates of change in the amount of light. The sensed rates of change in the amount of light are converted into a pulse-shaped voltage signal as shown in FIG. 8. FIG. 8 is a graph of the voltage signal when the jam removal cover 610 is open. In FIG. 8, the voltage signal is 'ON' in an open state of the jam removal cover 610, and 'OFF' in a closed state of the jam removal cover 610.

In embodiments of the present embodiment, the sensed rate of change in the amount of light in the full-loading state ($V_1$ of FIG. 7) is less than that in the case of the jam removal cover-open state ($V_2$ of FIG. 8), but is greater than zero. That is, the signal values $0<V_1<V_2$, can then be used to selectively distinguish between at least one of a normal condition, a full-loading condition, and a jam removal cover-open condition, respectively.

In embodiments of the present embodiment, because the rates of change in the amount of light in the full-loading state and jam removal cover-open state are sensed differently from each other through the optical sensor 540 unlike conventional full-loading sensing devices, corresponding signals do not overlap each other, leading to easy interpretation of the signals. Accordingly, sensing of full-loading state of the output bin section and sensing of opened jam removal cover can be performed in a separate or integrated mode.

As apparent from the above description and FIGS. 7 and 8, embodiments of the present invention provide a full-loading sensing device for an image forming apparatus wherein the 'ON' signal of a full-loading state and the 'ON' signal of a jam removal cover-open state are sensed by different values, and the full-loading state and jam removal cover-open state can thus be independently determined.

That is, in embodiments of the present invention, a single sensor can be used for sensing both the full-loading state and jam removal cover-open state, thereby simplifying a required sensing mechanism and lowering manufacturing costs thereof.

In addition, the simplified mechanism for sensing the full-loading state and jam removal cover-open state contributes to minimization of various operation-related errors and significant increase of product reliability.

While the present invention has been shown and described with reference to certain exemplary embodiments thereof, it will be understood by those skilled in the art that various changes in form and details may be made therein without departing from the spirit and scope of the invention as defined by the appended claims.

What is claimed is:

1. A full-loading sensing device, comprising:

at least one lever rotatable in different directions from reference locations by at least one of a loading of a discharged paper and an opening of a jam removal cover, respectively; and an optical sensor for sensing different rates of change in an amount of light corresponding to the respective rotational directions of the lever.

2. The full-loading sensing device of claim 1, wherein the lever comprises a light transmitting portion provided closely to the optical sensor.

3. The full-loading sensing device of claim 2, wherein the light transmitting portion comprises a translucent material.

4. The full-loading sensing device of claim 3, wherein the at least one lever comprises:

a first lever whose first end is contactable with the discharged paper loaded on an output bin section; and a second lever connected in an interlocked manner with the first lever, wherein the first lever and second lever are rotatable in an interlocked manner and the second lever comprises a light transmitting portion having a light transmittance differing from that of the second lever at a site near the optical sensor.

5. The full-loading sensing device of claim 4, wherein a second end of the first lever is adapted to contact a lower part of the jam removal cover.

6. The full-loading sensing device of claim 4, further comprising:

a pressurizing member elastically provided under the jam removal cover; and a pressure rib adapted to project from a side of the pressurizing member.

7. The full-loading sensing device of claim 3, wherein the optical sensor is configured to convert the sensed different rates of change in the amount of light into respectively corresponding voltage signals.

8. The full-loading sensing device of claim 7, wherein the voltage signals distinguish at least one of a normal condition, a full-loading condition, and a jam removal cover-open condition.

9. A full-loading sensing device, comprising:

a first lever rotatable in one direction by loading of a discharged paper and in another direction by opening of a jam removal cover;

a second lever rotatable in both directions reversely corresponding to the rotational directions of the first lever;

an optical sensor for sensing different rates of change in an amount of light corresponding to respective rotational directions of the second lever; and a light transmitting portion provided at a part of the second lever near the optical sensor, the light transmitting portion comprising a light transmittance differing from that of the second lever.

10. The full-loading sensing device of claim 9, wherein the light transmitting portion comprises a translucent material.

11. The full-loading sensing device of claim 9, wherein the first lever comprises:

a first end contactable with the discharged paper loaded on an output bin section; and a second end contactable with the jam removal cover provided in an openable/closable manner at a main body, wherein the first lever is adapted to rotate in directions opposite to each other in response to the loading of the discharged paper and the opening of the jam removal cover, respectively.

12. The full-loading sensing device of claim 9, wherein the optical sensor is configured to convert the sensed different rates of change in the amount of light into respectively corresponding voltage signals.

13. The full-loading sensing device of claim 12, wherein the voltage signals distinguish at least one of a normal condition, a full-loading condition, and a jam removal cover-open condition.

14. A full-loading sensing device, comprising:

a first lever rotatable by loading of a discharged paper;

a second lever rotatable in a first direction by rotation of the first lever and in a second direction by opening of a jam removal cover;

an optical sensor for sensing rates of change in an amount of light according to the first and second directional rotation of the second lever; and a light transmitting portion provided at an end of the second lever near the optical sensor, the light transmitting portion comprising a light transmittance differing from that of the second lever.

15. The full-loading sensing device of claim 14, wherein the light transmitting portion comprises a translucent material.

16. The full-loading sensing device of claim 14, further comprising:

a pressurizing member provided in an elastically supported manner under the jam removal cover; and a pressure rib adapted to project from a side of the pressurizing member, the pressure rib rotating the second lever in the second direction.

17. The full-loading sensing device of claim 14, wherein the optical sensor is configured to convert the sensed different rates of change in the amount of light into respectively corresponding voltage signals.

18. The full-loading sensing device of claim 17, wherein the voltage signals distinguish at least one of a normal condition, a full-loading condition, and a jam removal cover-open condition.

19. A method for sensing and selectively distinguishing a normal condition, a full-loading condition, and a jam removal cover-open condition, comprising the steps of:

rotating a first lever in a first direction by loading of a discharged paper and in a second direction by opening of a jam removal cover;

rotating a second lever in directions reversely corresponding to the rotational directions of the first lever, the second lever comprising a light blocking portion and a light transmitting portion for movement with respect to an optical sensor;

sensing different rates of change in an amount of light corresponding to movement of the second lever; and converting the sensed different rates of change in the amount of light into respectively corresponding voltage signals that distinguish at least one of a normal condition, a full-loading condition, and a jam removal cover-open condition.

20. The method of claim 19, further comprising the step of alerting a user of the full-loading condition and a jam removal cover-open condition.

21. An image forming apparatus, comprising:

an output bin section;

at least one lever which assembled to the output bin section rotatable in different directions from reference locations by at least one of a loading of a discharged paper and an opening of a jam removal cover, respectively; and an optical sensor for sensing different rates of change in an amount of light corresponding to the respective rotational directions of the lever.

22. The image forming apparatus of claim 21, wherein the lever comprises a light transmitting portion provided closely to the optical sensor.

23. The image forming apparatus of claim 22, wherein the light transmitting portion comprises a translucent material.

24. The image forming apparatus of claim 21, wherein the at least one lever comprises:

a first lever whose first end is contactable with the discharged paper loaded on an output bin section; and a second lever connected in an interlocked manner with the first lever, wherein the first lever and second lever are rotatable in an interlocked manner and the second lever comprises a light transmitting portion having a light transmittance differing from that of the second lever at a site near the optical sensor.

25. The image forming apparatus of claim 24, wherein a second end of the first lever is adapted to contact a lower part of the jam removal cover.

26. The image forming apparatus of claim 24, further comprising:

a pressurizing member elastically provided under the jam removal cover; and a pressure rib adapted to project from a side of the pressurizing member.

27. The image forming apparatus of claim 21, wherein the optical sensor is configured to convert the sensed different rates of change in the amount of light into respectively corresponding voltage signals.

28. The image forming apparatus of claim 27, wherein the voltage signals distinguish at least one of a normal condition, a full-loading condition, and a jam removal cover-open condition.

* * * * *